United States Patent [19]

Okabe et al.

[11] Patent Number: 4,590,784

[45] Date of Patent: May 27, 1986

[54] PRESS BRAKE

[75] Inventors: Jiro Okabe; Shunji Fujie, both of Yokohama; Haruki Takeuchi, Odawara, all of Japan

[73] Assignee: Nippon Kokan Kabushiki Kaisha, Tokyo, Japan

[21] Appl. No.: 753,013

[22] Filed: Jul. 8, 1985

[30] Foreign Application Priority Data

Jul. 27, 1984 [JP] Japan ..... 59-156886
Oct. 15, 1984 [JP] Japan ..... 59-215727

[51] Int. Cl.[4] ..... B21D 5/01
[52] U.S. Cl. ..... 72/389; 72/448; 72/450
[58] Field of Search ..... 72/386, 389, 450, 451, 72/448

[56] References Cited

U.S. PATENT DOCUMENTS

| | | | |
|---|---|---|---|
| 3,552,183 | 1/1971 | Heitman | 72/450 |
| 3,587,286 | 6/1971 | Fritsch | 72/389 |
| 3,587,288 | 6/1971 | Sharman | 72/450 |
| 3,766,771 | 10/1973 | Spaechner | 72/450 |
| 3,859,838 | 1/1975 | Karsnal | 73/451 |
| 4,411,148 | 10/1983 | Aschauer | 72/450 |

*Primary Examiner*—Leon Gilden
*Attorney, Agent, or Firm*—Frishauf, Holtz, Goodman & Woodward

[57] ABSTRACT

A press brake has a press cradle, which has an upper die and which is provided across two frames, and a ram, which has a lower die, and which moves up and down to perform a bending operation on metal sheets. The upper ends of the beams attached by pins at the lower ends to the ram are coupled by pins to ends of rotary links which are connected by pins to the press cradle. The rotary links are rotated in a fixed path by hydraulic cylinders rotatably provided on both frames to raise and lower the ram via the beams.

10 Claims, 13 Drawing Figures

PRESS BRAKE

BACKGROUND OF THE INVENTION

This invention relates to a press brake for bending metal sheets.

With prior art press brakes, a ram is moved straight up and down by a hydraulic cylinder attached to the housing frame. The metal sheet is bent by an upper die attached to the lower end of the ram and a lower die attached to the press cradle.

This kind of press brake, however, has the following problems.

(1) Because the ram is directly moved up and down by a hydraulic cylinder, it is impossible to decrease the ram travel in relation to the travel of the hydraulic cylinder the closer the ram comes to the end of its downward travel, so the rest position at the bottom travel limit (stopping accuracy) varies due to the presence of foreign matter in the hydraulic control valve and due to changes in oil temperature, etc. Similarly, variations occur in synchronization accuracy peformed by hydraulic control, which affects the sheet bending accuracy.

(2) when performing bending work with this kind of press brake, in order to improve work efficiency, the ram to which the upper die is attached is lowered at a high speed until the upper die reaches the plate bending region, where it must be slowed down. With the prior art press brake, however, it is not possible to satisfy the requirement of slowing down.

(3) Furthermore, the ram guide of the housing frame of a press brake, which is directly raised and lowered by a hydraulic cylinder, goes out of parallel with the vertical axis due to the deformation of the housing frame when pressure is applied so the ram cannot apply pressure in a perfectly vertical direction. Consequently, the ram, to which the upper die is attached, deforms and accurate bending becomes impossible.

SUMMARY OF THE INVENTION

In consideration of the above problems, this invention is characterized by comprising a pair of rotary links and beams for lowering and raising the ram. The ram is provided in the vertical guides of the housing frame to allow the ram to slide up and down. The pair of rotary links is attached at one end by a pin to the press cradle and rotated from the rear rotating limit, to the forward rotating limit in a prescribed range by the action of a hydraulic cylinder. The pair of left and right beams are supported at one end by pins on the left and right ends of the ram and coupled at the other ends to the other ends of the rotary links. (When the rotary links are at the rear rotation limit, these beams hold the ram in the position furthest from the press cradle, and when the rotary links are in the forward rotating limit, the beams hold the ram in the position closest to the press cradle.)

BRIEF DESCRIPTION OF THE DRAWINGS

This invention may be better understood by referring to the drawings in which.

DETAILED DESCRIPTION OF THE PREFERRED EMBODIMENTS

Figure 2:
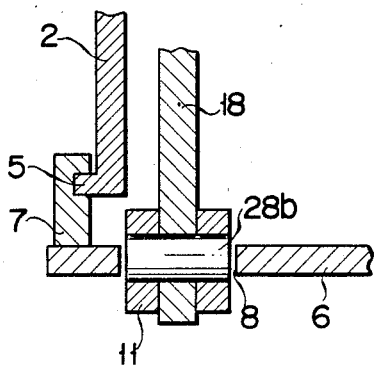
FIG. 2 is an enlarged transverse cross section of FIG. 1 along the line II—II.
Figure 3:
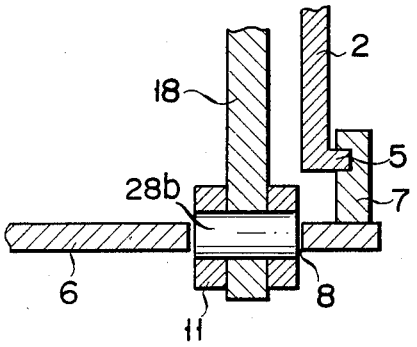
FIG. 3 is an enlarged transverse cross section of FIG. 1 along the line III—III.

The following is a detailed description taken in conjunction with the drawings of the first embodiment of the invention. The drawings show press body 1 in which the press cradle 3 for attaching the upper die is horizontally installed across left and right frames 2, 2. Protruding vertical guides 5, 5 are provided on the outer sides of the vertical front edge positioned under the press cradle 3 as shown in FIGS. 2 and 3.

Ram 6, which is oblong and is located transversely across frames 2, 2, slides up and down in vertical front guides 5, 5 of frames 2, 2 for raising and lowering the lower die. As shown in FIGS. 2 and 3, slide gibs 7, 7, for engaging with the vertical slide guides 5, 5, and vertical slots 8, 8 are provided on each side of the ram 6.

Ram 6 is equipped with a ram position adjustment device 10. Adjustment device 10 comprises a pair of left and right slide blocks 11, 11 slidably inserted in vertical slots 8, 8 on either side of the ram (the lower ends of beams 18, 18, which will be described later, are attached to these slide blocks by pins), worm reduction mechanisms 15, 15, which contain worms 13, 13 into which screws 12, 12 protruding from the top of slide blocks 11, 11 are screwed, and worm gears 14, 14, which mesh with worms 13, 13, and electric motor 17, whose reversible drive is transmitted to worm gears 14, 14 via rotary drive shaft 16, are housed in boxes fixed to the ram.

A pair of left and right rotary links 25, 25 are attached at one end by pins 26 at the bottom of press cradle 3 of the frames 2, 2. Rotary links 25, 25 are rotated forward and back within a fixed arc from the rear rotation position shown in FIG. 1A up to the forward rotation position shown in FIG. 1B by the action of hydraulic cylinders 27, 27, which are rotatably attached to the outside of frames 2, 2 by pins 27*a*.

Figure 1:
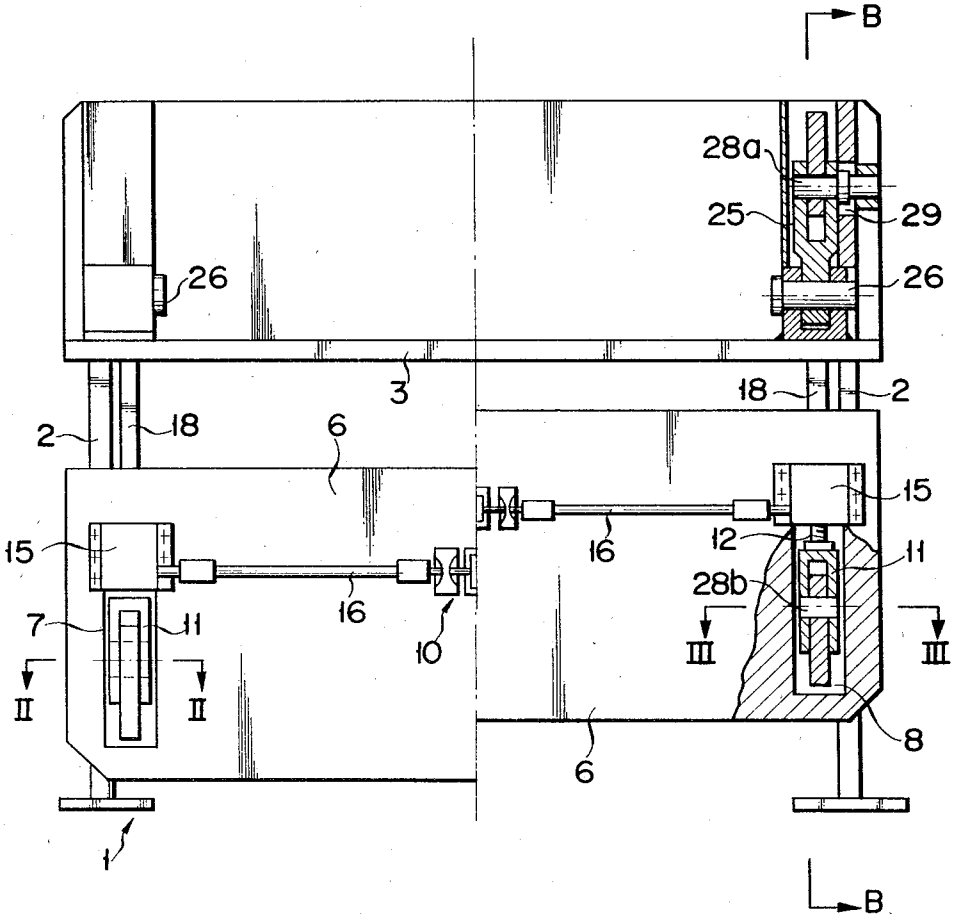
FIG. 1 is a partially cut away front view of the first embodiment of this invention in which the left side of the drawing shows the ram in the lowered position and the right side shows the ram in the raised position.
Figure 1B:
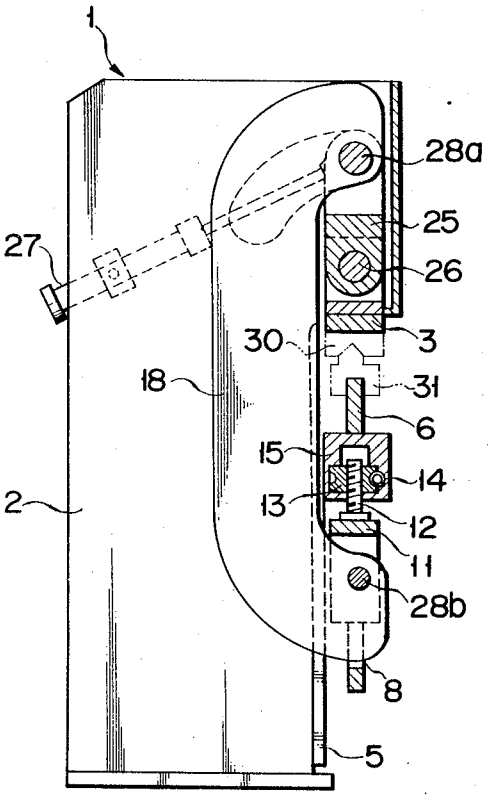
FIG. 1B is a cross section of FIG. 1 along the line B—B.
Figure 1A:
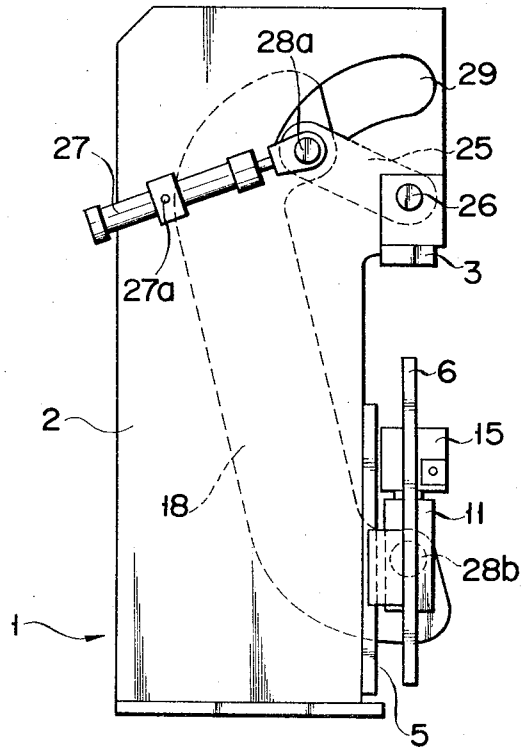
FIG. 1A is a left side view of FIG. 1.

A pair of beams 18, 18 for raising and lowering the ram are coupled at the upper ends to the distal ends of rotary links 25, 25 by pins 28*a*, 28*a*. The lower ends of the beams are attached to slide blocks 11, 11 at either side of ram 6 by pins 28*b*, 28*b*. When rotary links 25, 25 are rotated to the rear position, beams 18, 18 hold ram 6 in the lowered position as shown in FIG. 1A. When rotary links 25, 25 are rotated to the forward rotation position, ram 6 is raised to the upper position, as is shown in FIG. 1B. Beams 18, 18 are provided on the inner facing sides of the frames 2, 2 partially protruding from vertical guides 5, 5 on the front of the frames.

Arced slots 29, 29 for prescribing the range of rotation of the rotary links 25, 25 through which pins 28*a*, 28*a* are inserted coupling the upper ends of beams 18, 18 and the links, are provided at the top of frames 2, 2. The piston rod ends of hydraulic cylinders 27, 27 are coupled to the ends of pins 28*a*, 28*a* protruding from these arced slots 29, 29.

Upper die 30 is attached to the underside of press cradle 3 at the top of the press brake body as shown in FIG. 1B, and lower die 31 for pressing upward is attached to the upper end of ram 6. These dies 30, 31 perform the bending operation at the upper limit of the ram.

In the above embodiment, slide blocks 11, 11 are inserted inside slots 8, 8 of ram 6. When the ram is raised to its uppermost position, the supporting pins 28*a*, 28*b* on the lower and upper ends of beams 18, 18 and the frame pin supports 26 of rotary links 25, 25 are on a vertical axis passing through the center of the ram, as is shown in FIG. 1B. It is also possible for the lower ends of beams 18, 18 to be pinned directly to the left and right sides of ram 6. However, in this case, it is not possible to use the ram position adjustment device 10, so, it is necessary to provide a shim between press cradle 3 and upper die 30 for indirectly adjusting the position of the ram by varying the thickness of the shim.

With a press brake constructed as described above, when the pair of left and right rotary links 25, 25 are rotated from the rear position shown in FIG. 1A to the forward position shown in FIG. 1B by the action of hydraulic cylinders 27, 27, this link motion causes beams 18, 18 to rise while moving forward using the lower pin support (positioned at pin 28*b*) as a fulcrum. This motion of the beam causes ram 6 to rise guided by vertical guides 5, 5 on both sides frames 2, 2 to thereby bend the sheet between the lower die 31 attached to the top of the ram and the upper die 30 attached to upper press cradle 3.

In this case, the distance of travel of the ram decreases in relation to the travel of the hydraulic cylinder the nearer the ram draws to the upper limit. In other words, compared to the constant motion of hydraulic cylinders 27, 27, lower die 31 attached to ram 6 moves rapidly until it reaches the sheet bending region and then when it begins the bending process, it slows down to the working speed.

In this embodiment, ram 6 is raised by beams 18, 18 to perform the bending operation so the backlash of the ram position adjustment screw and pin support is eliminated by the weight of the ram and beam, resulting in more accurate bending.

Figure 5:
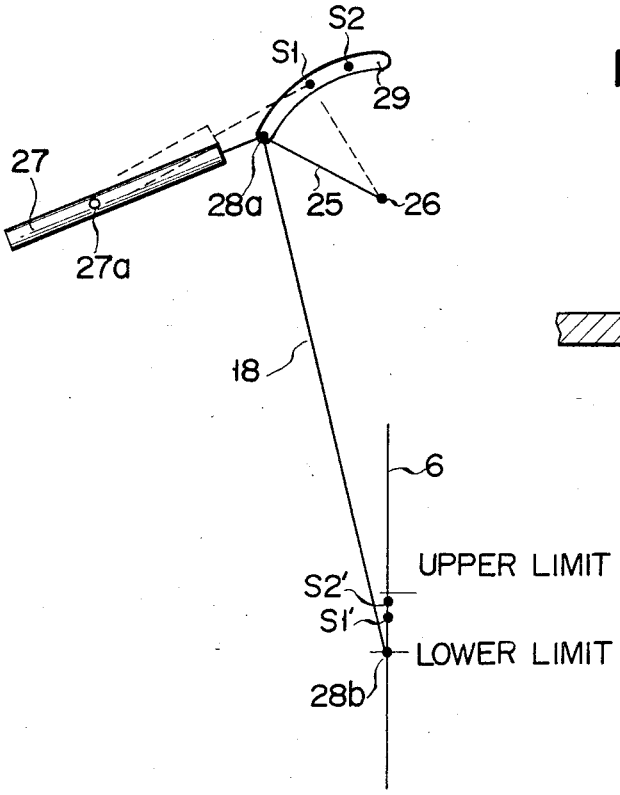
FIG. 5 shows the operation of the above press brake.
Figure 4:
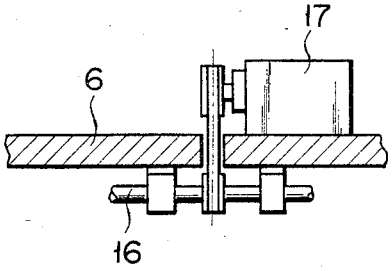
FIG. 4 is a transverse cross section showing the electric motor attachment position of the ram position adjustment device.
Figure 6:
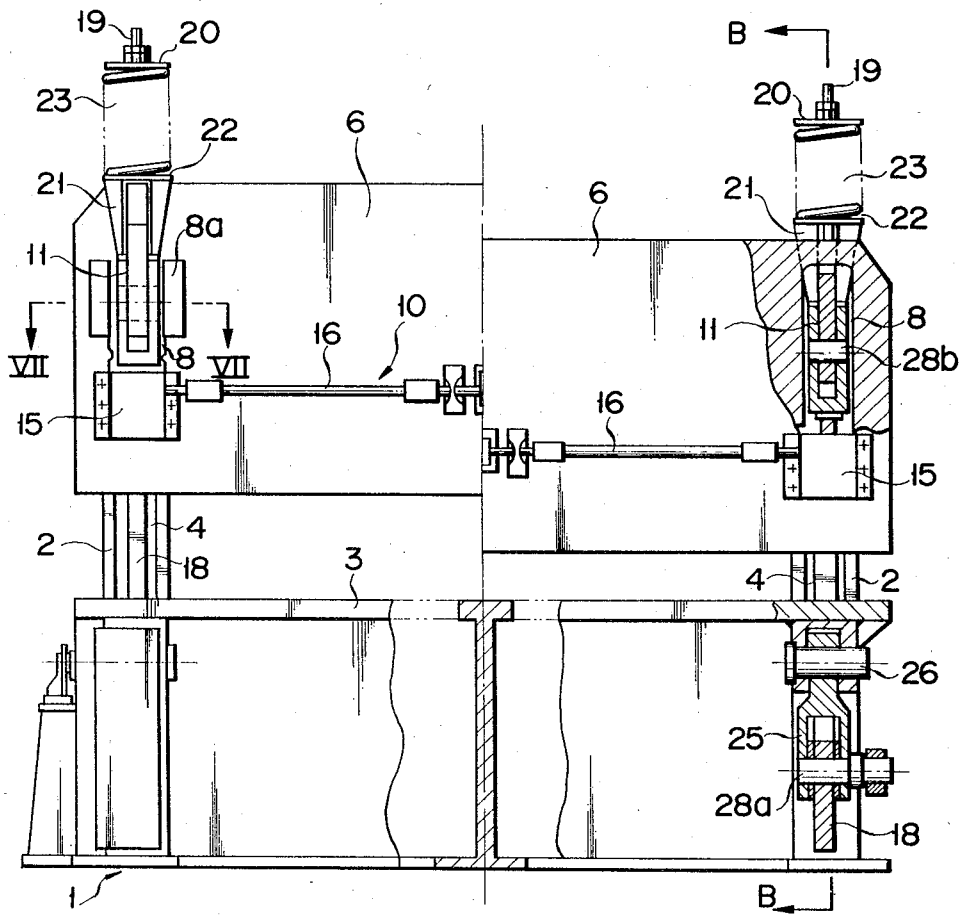
FIG. 6 is a partially cut away front view of the second embodiment of this invention in which the left side of the drawing shows the ram in the raised position and the right side shows the ram in the lowered position.
Figure 6B:
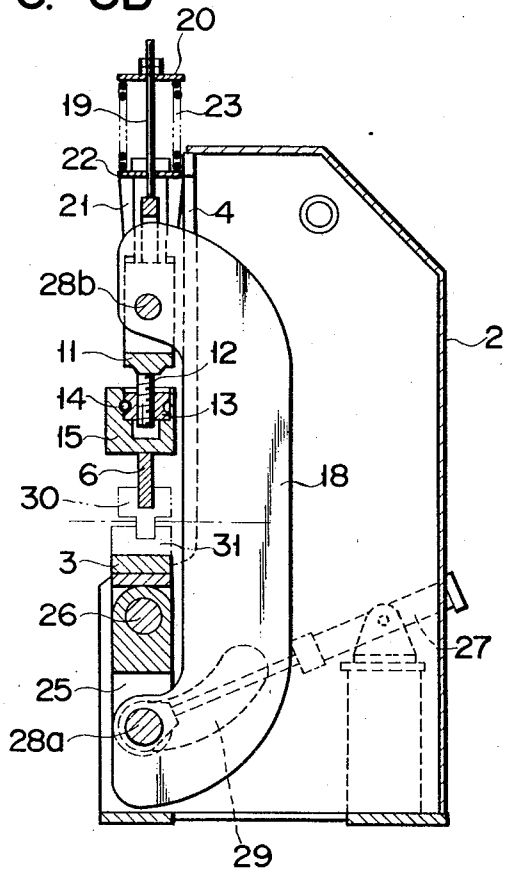
FIG. 6B is a cross section of FIG. 6 along the line B—B.
Figure 6A:
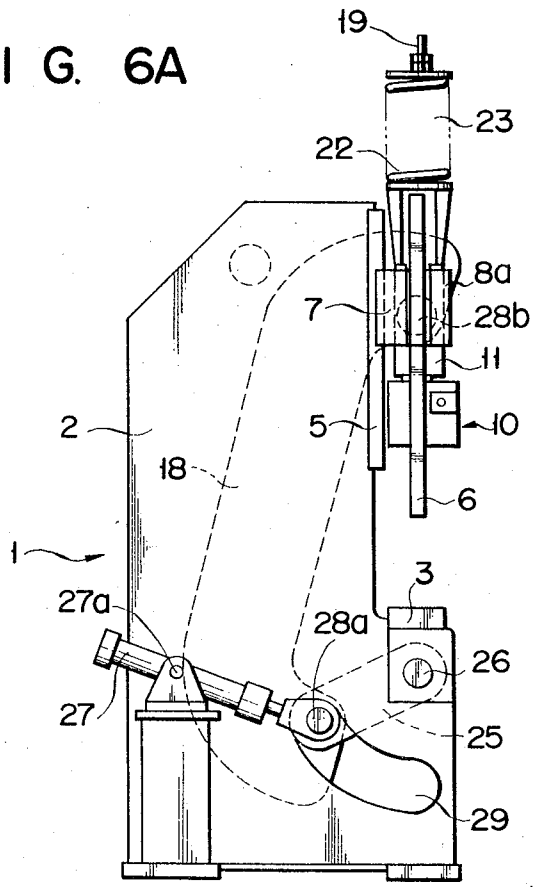
FIG. 6A is a left side view of FIG. 6.
Figure 8:
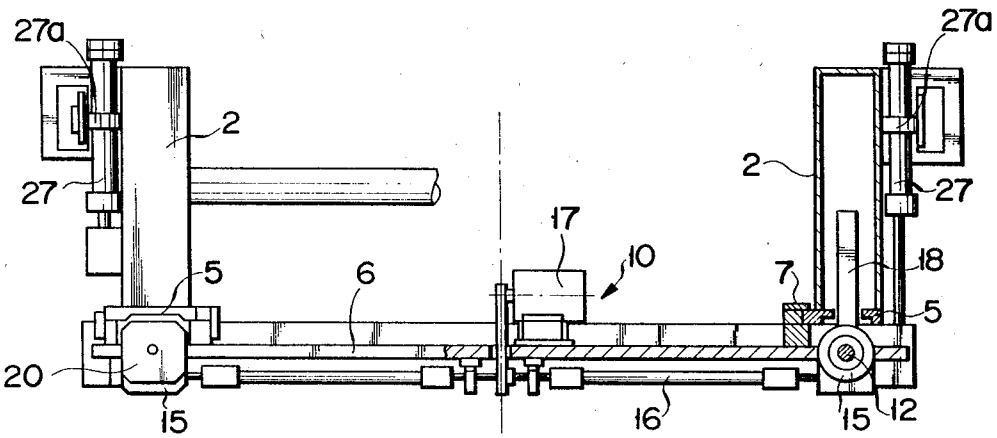
FIG. 8 is a partially cut away plan view of FIG. 6.

FIG. 5 shows a model of the above operation. When the position of coupling pins 28*a* for the links and beams operated by hydraulic cylinder 27 is moved from the rear position of the links to position S1 at $\frac{1}{2}$ of the cylinder stroke, position S2 at $\frac{3}{4}$ of cylinder stroke, etc., the position of pins 28*b* at the lower end of beam 18, moves from the lower pin position to the 11/15 position S1′ and to the 15/13 position S2′, gradually decreasing the distance and the speed moved as the ram approaches the upper position.

EFFECT OF THE INVENTION

By providing a link motion mechanism between the hydraulic cylinder and the ram, the press brake of this invention has the following advantages:

(1) The distance of travel of the ram in relation to the fixed travel of the hydraulic cylinder decreases as the ram draws near the upper position so it is possible to achieve higher stopping accuracy of the ram using hydraulic cylinders of conventional stopping accuracy.

(2) The productivity of the press brake is improved because the lower die attached to the ram is raised rapidly until it reaches the sheet bending region.

(3) Since the amount that the ram is raised near the top position in relation to the fixed travel of the hydraulic cylinder is extremely small, very large pressure load can be obtained.

(4) Furthermore, the prior art press brake moved the ram up and down directly with the hydraulic cylinder so that deflection of the housing frame during the pressurized period resulted in the ram guides being out of alignment, decreasing the accuracy of the work. With the press brake of this invention, there is no load or pressure deformation of the housing frame so the ram moves downward accurately, making accurate bending possible.

SECOND EMBODIMENT

The following is a description with reference to FIGS. 6 to 9 of the second embodiment of this invention. In the first embodiment the press cradle 3 is provided above the press brake to perform the bending work with the rise of ram 6. In the second embodiment press cradle 3 is mounted on the lower side of the press brake to perform the bending work with the lowering of ram 6.

Figure 7:
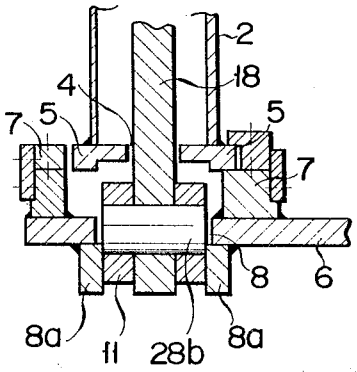
FIG. 7 is an enlarged transverse cross section of FIG. 1 along the line VII—VII.
Figure 9:
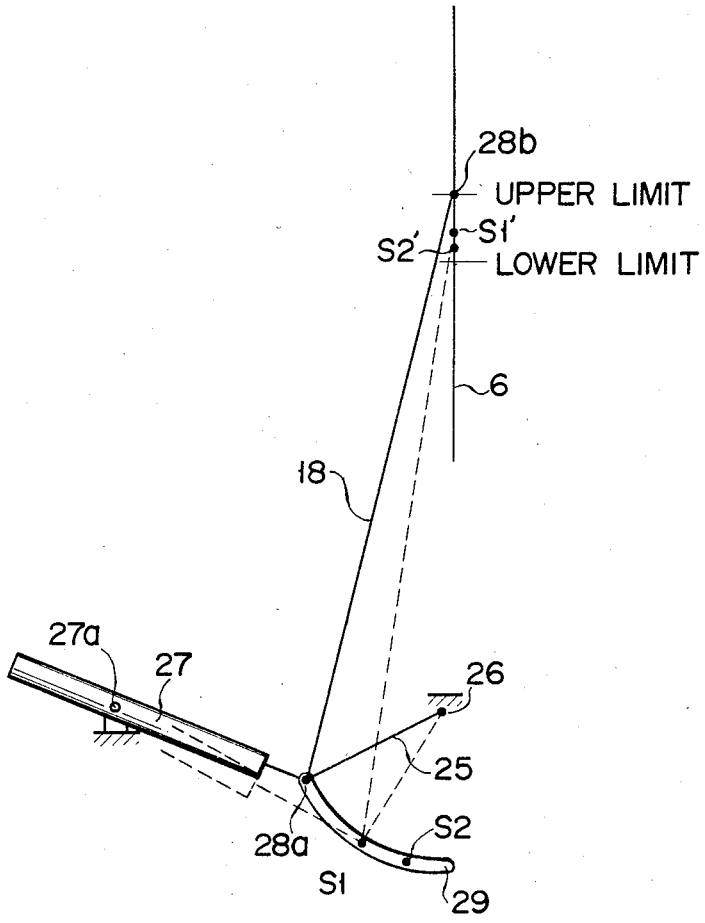
FIG. 9 shows the operation of the above press brake.

In that the link mechanism of rotary links 25, 25 and beams 18, 18, etc. and the link drives are acted upon by hydraulic cylinders 27, 27 in the basic mechanism, and a ram position adjustment device is provided, the second embodiment is the same as the first. However, the upper ends of beams 18, 18 are attached to slide blocks 11, 11 by pins 28*b*, 28*b* and the lower ends of beams 18, 18 are coupled to the distal end of rotary links 25, 25 by pin 28*a*, 28*a*. As shown in FIG. 7, both frames 2, 2 are hollow and have elongated slots 4, 4 in the front. Vertical guides 5, 5 protruding from the front sides are provided on the frames, which protrude from the top of press cradle 3. Slide gibs 7, 7 which engage with vertical guides 5, 5 are provided on the left and right ends of ram 6, and guide slots 8, 8 and guide members 8*a*, 8*a* for guiding slide blocks 11, 11 are provided vertically on the left and right ends as well.

Spring stoppers 20, 20 are fastened to attachment rods 19, 19 at the top of the left and right ends of ram 6. Spring stoppers 22, 22 are movably provided in relation to attachment rods 19, 19 and are fixed to the top of slide blocks 11, 11 via attachment legs 21, 21. Balance springs 23, 23 are provided between spring stoppers 20, 22 for urging ram 6 upwards. With this kind of structure it is possible to eliminate backlash of the ram position adjustment screws and the pin supports resulting in more accurate bending.

With this embodiment, as well, the same effect as that obtained in the first embodiment is obtained.

What is claimed is:

1. A press brake, comprising:

a press brake body havinag a die mounted on a press cradle across a pair of left and right frames;

a ram, oblong in shape, having a die, and provided transversely acaross both ends of said frames, and guided up and down by vertical guides on the front of both said frames, and a drive device for driving said ram up and down in relation to said press cradle;

a pair of left and right rotary links attached at one end to said press cradle by pins;

a pair of left and right hydraulic cylinders, rotatably provided on said press cradle, for moving said rotary links from a rear position of the distal ends of said rotary links to the forward position in a fixed arc; and a pair of left and right beams connected at one end to the left and right ends of said ram by pins and at the other end to the distal ends of said rotary links by pins, said ram being supported in a position nearest said presss cradle when the distal ends of said rotary links are in the forward rotation position, and being supported in a position furthest from the press cradle when said rotary links are in the rear rotation position.

2. A press brake according to claim 1, wherein said press cradle, which has an upper die on its lower surface, is provided at the top of both frames, and said ram, which has a lower die attached to its upper surface, is provided under the lower surface of said press cradle.

3. A press brake according to claim 2, wherein beams are provided on the inner facing sides of both frames partially protruding from the vertical guides on the front of said frames, arced elongate holes for prescribing the arc of said rotary links through which pins coupling the upper end of said beams with the distal ends of said rotary links are provided on the top of said frames, and the piston rod ends of said hydraulic cylinders are coupled to the pin ends protruding outward from said arced elongate holes.

4. A press brake according to claim 2, wherein said ram further comprises a ram position adjustment device which includes a pair of left and right slide blocks supported by pins at the lower end of said beams and adjustable in the vertical direction, worm reduction mechanisms fastened to the inside of said ram and containing worms, into which srews protruding from said slide blocks are screwed, and worm gears, which mesh with said worms, and a reversible electric motor for rotating said worm gears of said worm reduction mechanisms.

5. A press brake according to claim 4, wherein said slide blocks are slidably inserted into a vertical elongate holes on the left and right ends of said ram and frame pin supports of said rotary links and pin supports at the upper and lower ends of said beams are positioned on a vertical axis passing through the center of said ram when said ram is in the upper position.

6. A press brake according to claim 1, wherein said press cradle, which has a lower die on the upper surface, is provided on the lower side of both frames, and said ram, which has an upper die on the lower surface, is provided above said press cradle.

7. A press brake according to claim 6, wherein said beams are mounted in said pair of left and right frames partially protruding from the vertical slots in the front of said frames, arced elongate holes for prescribing the rotation arc of said rotary links through which said coupling pins for coupling the lower ends of said beams and the distal ends of said rotary links, are provided in the side walls of said frames, and piston rod ends of said hydraulic cylinders are coupled to the coupling pin ends protruding from said arced elongate holes.

8. A press brake according to claim 6, wherein said ram further comprises a ram position adjustment device which includes a pair of left and right slide blocks supported by pins at the lower ends of said beams, worm reduction mechanisms fastened to the inside of said ram and containing worms, into which screws protruding from said slide blocks are screwed, and worm gears, which mesh with said worms, and a reversible electric motor for rotating said worm gears of said worm reduction mechanisms.

9. A press brake according to claim 8, wherein a balance spring for urging said ram upward is provided between said ram and said sliding blocks.

10. A press brake according to claim 8, wherein said slide blocks are inserted into the sliding guide slots provided on the left and right ends of ram and frame pin supports of said rotary links and pin supports at the upper and lower ends of said beams are positioned on a vertical axis passing through the center of said ram when said ram is in the lower position.

* * * * *